US006007394A

United States Patent [19]

Kagan

[11] Patent Number: 6,007,394

[45] Date of Patent: Dec. 28, 1999

[54] RETRACTABLE SURFBOARD BINDING DEVISE

[76] Inventor: Miguel Kagan, 1004 Calle Toledo, San Clemente, Calif. 92672

[21] Appl. No.: 09/322,045

[22] Filed: May 28, 1999

[51] Int. Cl.[6] ..... B63B 35/79

[52] U.S. Cl. ..... 441/74; 441/70

[58] Field of Search ..... 441/65, 70, 74, 441/75; 114/39.14, 39.12

[56] References Cited

U.S. PATENT DOCUMENTS

| | | | |
|---|---|---|---|
| 4,645,466 | 2/1987 | Ellis | 441/74 |
| 4,775,345 | 10/1988 | Gifford | 441/75 |
| 4,929,208 | 5/1990 | Corica | 441/75 |
| 4,990,113 | 2/1991 | Morrison | 441/75 |
| 5,167,553 | 12/1992 | Wilson | 441/75 |
| 5,308,271 | 5/1994 | Foulke | 441/74 |
| 5,460,558 | 10/1995 | Woodstock | 441/74 |
| 5,484,312 | 1/1996 | Zepeda | 441/74 |
| 5,544,919 | 8/1996 | Tinkler | 280/809 |
| 5,591,060 | 1/1997 | Forsyth | 441/75 |

*Primary Examiner*—Ed Swinehart

[57] ABSTRACT

A retractable foot binding devise comprising a base member (20) with a cavity (32) centrally defined therein attachable to the deck of a surfboard, and a pivotal member (22) having a front and back end, positioned within the base's cavity, pivotally coupled to the base member, and springably urged upward on the front end to a predetermined angle. As the surfer lays on his or her board to paddle, the pivotal member is completely retracted within the base member creating a flat, comfortable paddling surface with minimal or no elevation above the deck of the surfboard. As the surfer stands, the pivotal member is springably urged upward on the front end to a predetermined angle. The surfer inserts his or her foot under the inclined pivotal member in a quick, natural standing motion. The omission of any impeding elements in the foot engageable portion facilitates full engagement and does not hinder necessary foot adjustments. The binding devise provides the surfer support and attachment to his or her board. The pivotal member may be locked in the retracted position for preferential option to employ. The binding devise is completely removable and adjustable.

20 Claims, 6 Drawing Sheets

RETRACTABLE SURFBOARD BINDING DEVISE

BACKGROUND

1. Field of Invention

This invention relates to surfboards, specifically an improved foot binding devise for a surfboard.

2. Description of Prior Art

With the convergence of advancing surfboard design and improving technical skills, surfers are attempting increasingly difficult maneuvers. In order for a surfer to complete modern technical maneuvers, his or her feet must remain attached to the deck of the surfboard. Related sports such as windsurfing, skiing, snowboarding, wakeboarding, and waterskiing have adopted binding devises or foot support apparatuses that successfully attach the user to his or her equipment. This binding action empowers athletes to perform maneuvers otherwise extremely difficult. As prior art notes, a practical, effective binding devise would be advantageous for the progression of surfing. The desire to provide an acceptable form of attachment has been strong. Numerous inventors have proposed and have received patents on an array of innovative devices. None, however, have proven acceptable in practice. The devices heretofore known suffer from a number of disadvantages:

a) Use of Hands. Some devices proposed, such as a strap (U.S. Pat. No. 4929208 to Corica, 1990) or handgrip (U.S. Pat. No. 4990113 to Morrison, 1991), require the use of a surfer's hand or hands while performing a maneuver. In the case of the strap, the surfer pulls his or her board against his or her feet using a strap attached to the deck of the board to perform maneuvers. For the handgrip, a grip is mounted onto the deck of a board and the surfer must bend over to grab the grip to hold onto the surfboard to perform maneuvers. Because surfers use their legs to maneuver their boards and their arms primarily for momentum and balance, apparatuses that incorporate the use of a surfer's hand or hands during maneuvers present great difficulties.

b) Lack of Attachment. Accordingly, devises that increase frictional traction for a surfer's feet (for example, U.S. Pat. No. 5308271 to Foulke, 1994) and increase support for the surfer's feet (for example, U.S. Pat. No. 5460558 to Woodstock, 1995) are more functional and are actually frequently used in practice. Although non-slip pads and foot saddles reduce slipping and add a degree of control, they are limited in that they do not provide attachment.

c) Impeded Engagement. Numerous foot loop or foot strap devises similar to those attached to sailboards have been proposed for surfboards (for example, U.S. Pat. No. 5167553 to Wilson, 1992). Because there is a supporting element over the top of a surfer's foot or feet, these devises provide the desired attachment. However, because such devices have an impeding strap or loop element where the surfer would normally place his or her foot when standing, the devises create an obstacle for the surfer to stand. Once standing, the surfer must temporarily lift his or her foot off the board and slip it underneath the loop or strap. Some devices even require the surfer to use his/her hand or hands to strap in for attachment. As surfing requires a tremendous amount of balance, this unnatural foot engagement motion proves quite difficult and may cause the surfer to fall. This motion is also time consuming which is especially detrimental because waves often crash quickly or offer short rides; time spent haggling with engagement is time away from enjoying the ride. These complications are compounded when the surfer attempts to engage both feet in a pair of binding apparatuses. In sum, proposed foot loop or strap devises create an obstacle for standing, require awkward movements for engagement, and are time-consuming to operate—perhaps all factors that help explain why such devises are not widely implemented.

d) Discomfort in Paddling. Another great design obstacle for creating a functional foot binding devise is the issue of comfort while paddling, an obstacle not present with many other related sports. When paddling, the surfer lays in the prone position atop his board. The surfer's chest lays flat on the surfboard, where his or her front foot will be positioned when he or she stands. This factor alone renders much prior art unacceptable on account of the discomfort of paddling caused by a protruding devise. U.S. Pat. No. 5484312 to Zepeda, 1996 shows a support apparatus which is collapsible, yet as the surfer lays to paddle on his or her board, the collapsed foot piece creates a protrusion on the deck of the board. Even a slight protrusion can cause great discomfort.

e) Elevated Surface and Added Weight. U.S. Pat. Nos. 5544919 to Tinkler, 1996 and 5591060 to Forsyth, 1993 show similar collapsible apparatuses. Both have an upper portion that folds down on top of a lower portion. The drawback of having an upper and lower portion is that it requires an undesirable elevation off the deck of the surfboard. Again, this causes discomfort while paddling. To accomodate this protruding apparatus, Tinkler proposes surrounding padding elevated to an equal height. However, padding just over the apparatus causes an uncomfortable arch in the surfer's back when paddling. Padding covering the deck of the board adds weight, size and cost—distinct disadvantages. Further, there is an inverse relation between elevation off the deck of the surfboard and control. The higher off the deck of the surboard the surfer is during paddling and surfing, the less control he or she has over the board.

f) Impeded Adjustments. U.S. Pat. Nos. 5544919 to Tinkler, 1996 and 5591060 to Forsyth, 1993 also include a strap element in the foot engageable portion between the upper and lower portions. As the user enters his or her foot into the support, he/she presses his/her foot against the strap. The strap cinches closed the upper portion of the support on top of the user's foot. The problem with this mechanical cinching action is that if the user inserts an unintended portion of his or her foot into the apparatus, the devise may cinch closed, and readjustment into the proper location is difficult as the support is cinched down on the user's foot. Further, the strap in the foot engageable portion may hinder full engagement of the surfer's foot into the support or cause the surfer to get entangled. Also, the minor side-to-side rocking, lateral, and forward and backward foot adjustments required for maneuvering the surfboard are restricted when the devise is clinched closed.

g) Lack of Removability. Prior art discloses a variety of devises that protrude off the deck of a surfboard. Surfboards are often stacked for transport. A protruding devise increases space requirements for transport which increases costs (in the case of shipping and travel) and decreases convenience. Similarly, protruding devices increase space requirements for storage. No known binding devise which allows quick, easy engagement and comfortable paddling may be completely and easily removed from the deck of a surfboard for improved transport and storage.

h) Lack of Option to Employ. A major drawback for proposed apparatuses is the lack of an easy option for a surfer to decide whether or not to employ the support apparatuses from session to session or on a wave-by-wave basis during the same surfing session. As the size and form of waves continually change, there are conditions and waves where a foot support apparatus may not prove beneficial. No known devices enable surfers to preferentially decide whether or not to employ the support apparatuses based on the conditions or their whim.

i) Lack of Adjustability. Surfers either stand on their boards with their left foot forward (regular foot) or with their right foot forward (goofy foot). Some surfers have wide stances; some have narrow stances. Some place their feet perpendicular with the board; some more at an angle. Some surfers borrow boards; some rent boards. The size of the surf, which is in constant flux, also dictates where a surfer will stand. Apparatuses or devises that are securely attached to the surfboard fail to address the need for surfers to easily adjust their apparatuses or devises, often in the ocean, without tools. No known acceptable binding devise allows surfers complete adjustability after initial attachment.

j) Difficult Disengagement. Footwear has also been proposed to provide surfers attachment to their boards. Suction cups attached to a band under a surfer's foot to grip the board have been proposed (U.S. Pat. No. 4775345 to Gifford, 1988). So too have hook-and-loop footwear where the hook-bearing material on the surfer's footwear and the loop-bearing material on the surfboard deck unite to attach the surfer to his or her board (U.S. Pat. No. 4645466 to Ellis, 1985). These devises have some major drawbacks: They grip at a first connection point which is rarely the desired location of a surfer's feet. Furthermore, if they create a sufficiently strong attachment for technical maneuvers, they do not allow a surfer to easily adjust her/his feet once attached. Additionally, if they provide a sufficiently strong attachment, they do not allow for easy detachment from the surfboard which can prove quite hazardous.

OBJECTS AND ADVANTAGES

Accordingly, several objects and advantages of the present invention are:

a) to provide a binding devise which does not require the use of a surfer's hand or hands to perform maneuvers;

b) to provide a binding devise that provides multi-directional support and attachment so a surfer may remain attached to his or her board while performing advanced maneuvers;

c) to provide a binding devise which allows a surfer to engage his or her foot or feet in a quick, natural movement which does not require the use of hands or cumbersome movements;

d) to provide a binding devise which retracts into itself providing a flat, comfortable paddling surface;

e) to provide a binding devise which minimizes or completely eliminates the device's elevation above the deck of the surfboard, enhances comfort, control, and minimizes additional weight;

f) to provide a binding devise which omits any impeding strap element in the foot engageable portion and any mechanical clinching action, allowing a surfer to completely engage his/her foot or feet and further does not restrict necessary foot adjustments;

g) to provide a binding devise which may be easily removed for more efficient transport and storage of the surfboard;

h) to provide a binding devise which may be retracted and may be easily locked in the retracted position allowing surfers to preferentially select whether or not to employ the devise on a wave-by-wave basis;

i) to provide a binding devise which is quickly and easily adjustable (in complete rotation, from side to side, and forward and backward) without the use of tools;

j) to provide a binding devise which allows the surfer safe, easy disengagement.

Further objects and advantages are to provide a binding devise that is durable, easy to use, inexpensive to manufacture, and ultimately adds attachment, support, and maneuverability enhancing the pleasure and exhilaration of the surfing experience. Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

20 Base Member
22 Pivotal Member
24 Hinge or Substitutable Pivotal Attachment
26 Eyelet or Substitutable Fastening Means
28 Nylon Webbing or Substitutable Terminating Means
30 Elastic Strap or Substitutable Springing Means
32 Cavity
34 Base Member Padding
36 Pivotal Member Padding
38 Interlocking Releasable Fastening Material
40 Lock or Substitutable Locking Means
42 Lock Insertion Point -continued 44 Surfboard
46 Binding Devise
48 Surfer's Foot
50 Surfer's Hand
52 Lock Insertion Member
54 Foot Engageable Portion
56 Pin
58 Crease Between Pivotal Portion and Base Portion
60 Resilient Bands
62 Compression Springs
64 Spring

SUMMARY

In accordance with the present invention, a retractable binding devise comprises a base member with a cavity, and a pivotal member having a front and back end, pivotally attached to said base member on the back end and springably urged upward to a predetermined angle on the front end.

DESCRIPTION—FIGS. 1A–5B, 10A–11C

Figure 1A:
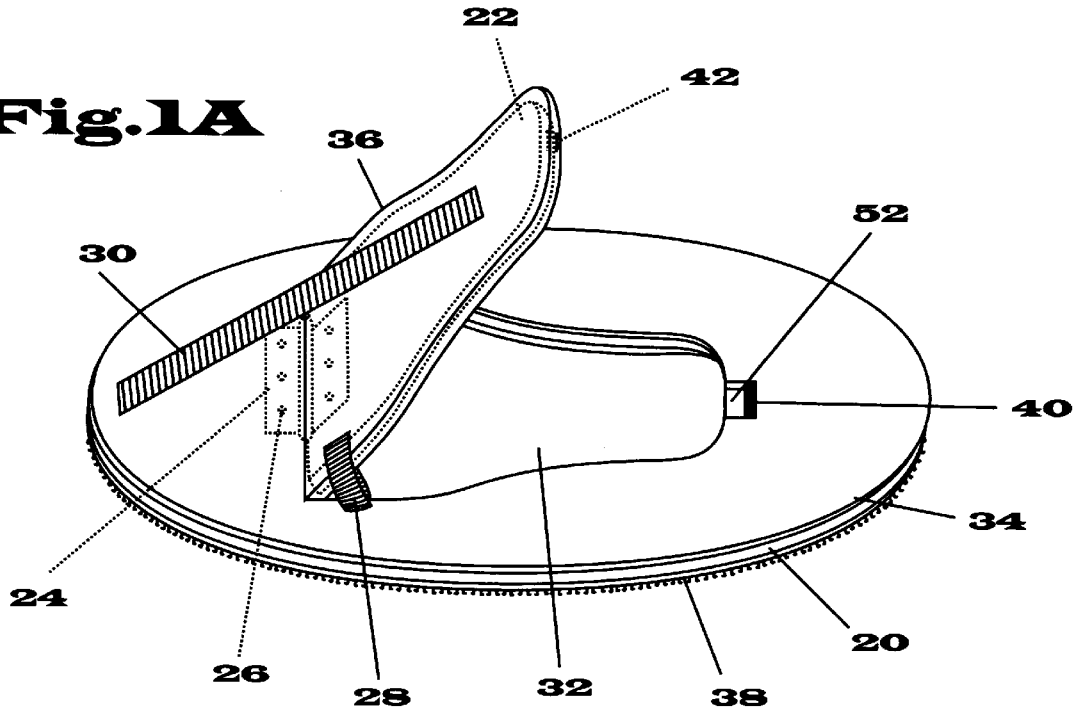
FIGS. 1A and 1B show a perspective view of a retractable binding devise with the pivotal member in the raised position, and retracted into the cavity of the base member respectively.
Figure 1B:
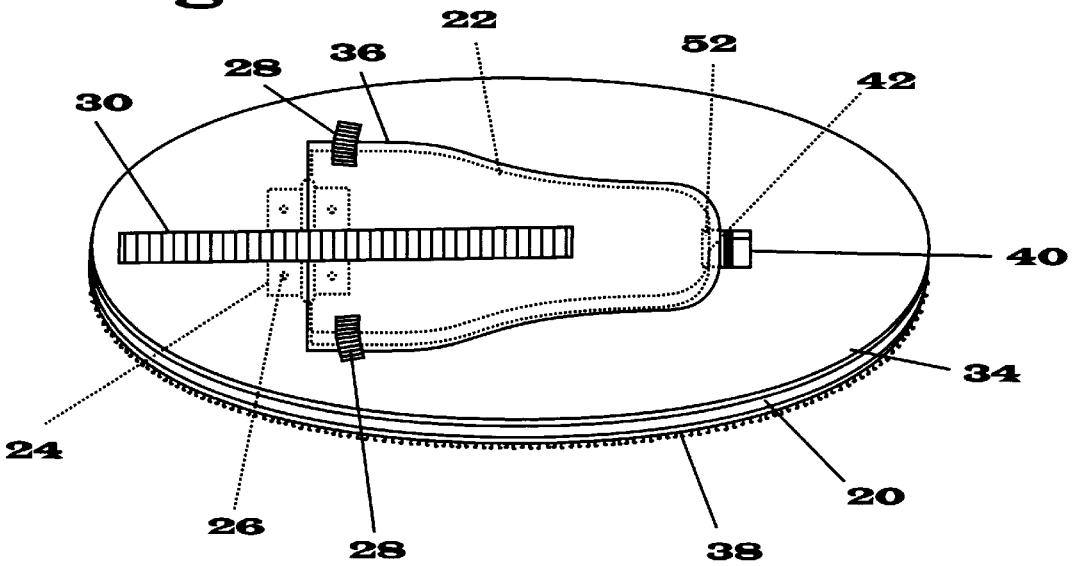
Figure 2A:
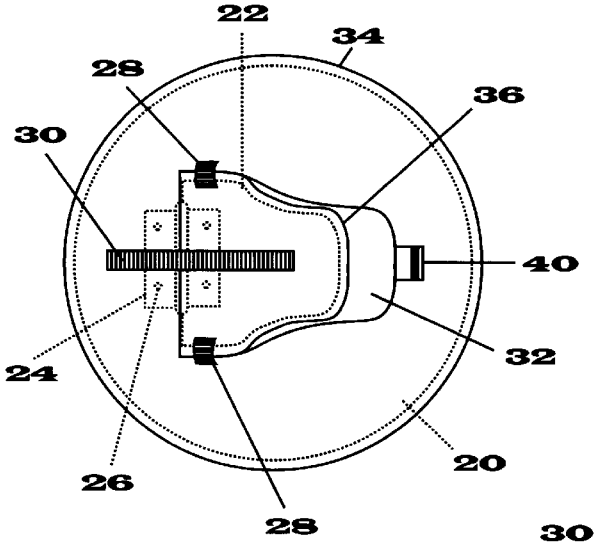
FIGS. 2A and 2B show a top view of a retractable binding devise with the pivotal member in the raised and retracted position respectively.
Figure 2B:
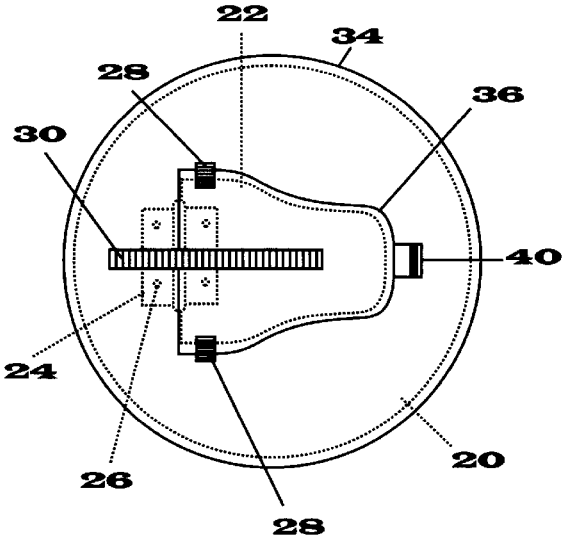
Figure 3A:
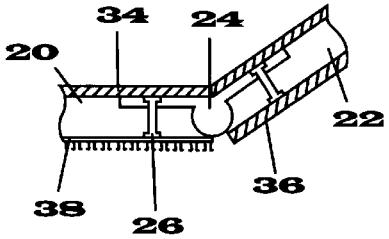
FIGS. 3A and 3B show a sectional view of a construction of the pivotal mounting of the pivotal member to the base member in the raised and retracted position respectively.
Figure 3B:
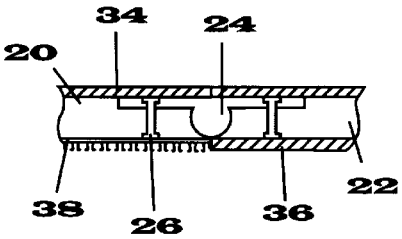
Figure 4A:
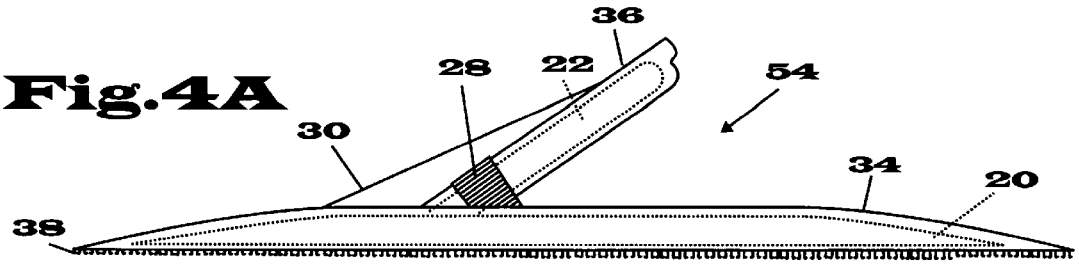
FIGS. 4A and 4B show a side elevational view of a retractable binding devise with tapered edges in the raised and retracted position respectively.
Figure 4B:
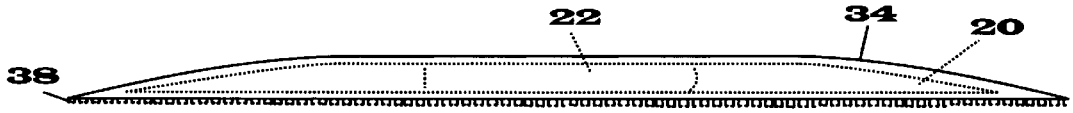

A typical embodiment of the binding devise of the present invention is illustrated in FIGS. 1A–B (perspective views), FIGS. 2A–2B (top views), FIGS. 3A–3B (sectional views of the construction of a pivotal attachment), and FIGS. 4A–4B (side elevational views). FIGS. 1A and 1B show the binding devise with a thin, flat base member 20. The base member 20 is a durable plastic material, such as polycarbonate. However, the base can consist of any other thin, durable material such as another form of plastic, rubber, metal, fiberglass, etc. The preferred shape of the base 20 is circular for rotatable adjustment on the deck of a surfboard, yet may take any other shape. The base 20 has a cavity 32 centrally defined therein.

FIG. 1B shows a thin pivotal member 22 positioned within the cavity, and pivotally attached on the back end to the base member 20 with a hinge 24. This pivotal attachment allows the front end of the pivotal member 22 to be springably urged upward (FIG. 1A). The hinge 24 is preferably stainless steel. However, any other material substantially durable to withstand high impact and the corrosive effects of ocean water may be substituted. The advantage of a hinge for pivotal attachment is the strength it provides.

FIGS. 3A and 3B (sectional views) illustrate the construction of a pivotal attachment of the pivotal member 22 to the base 20. The hinge 24 is recessed into and attached with eyelet fasteners 26 on one side to the upper surface of the base 20; it is recessed into and similarly attached on the other side to the upper surface of the pivotal member 22. The fasteners 26 are also preferably made of stainless steel, but may be made of any other substitutable material. Any other type of fasteners providing substantial attachment may be substituted, such as screws, nuts and bolts, grommets, etc. Alternatively, the hinge 24 may be attached using a form of adhesive. The circular pin portion of the hinge 24 is sandwiched between the base 20 and the pivotal member 22, and does not extend below the lower surface of the base 20 and pivotal member 22. FIG. 3B shows the hinge 24 attached to and recessed within the base 20 and pivotal member 22, creating a flat upper and lower surface when the pivotal member 22 is in the lowered, retracted position.

Figure 10A:
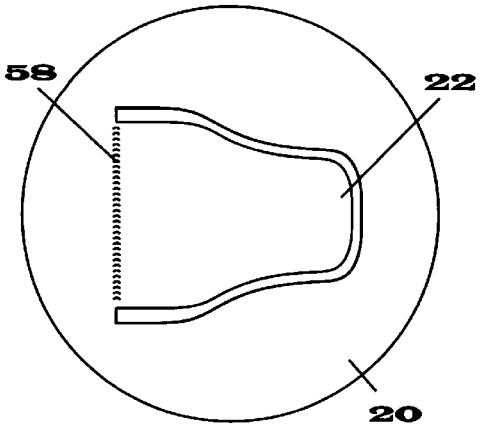
FIGS. 10A–10C show a top view of three alternate emodiments of a unitary retractable binding devise.
Figure 11A:
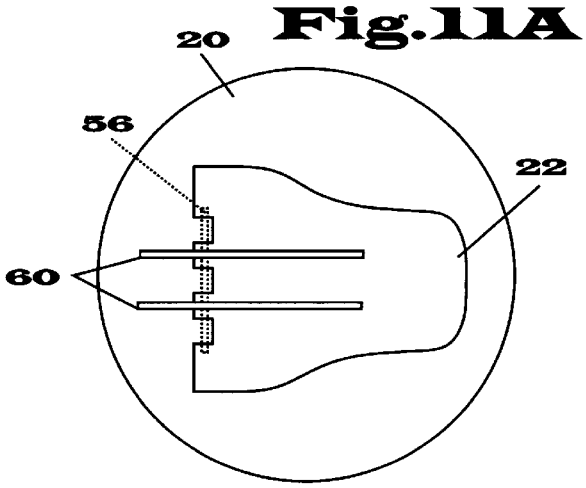
FIGS. 11A–11C show a top view of three alternate embodiments of a retractable binding devise.
Figure 10B:
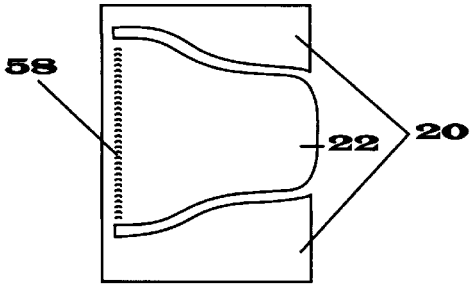
Figure 11B:
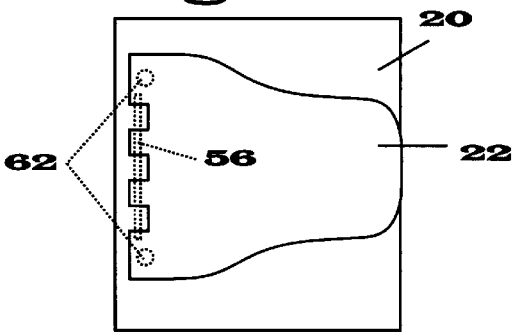
Figure 10C:
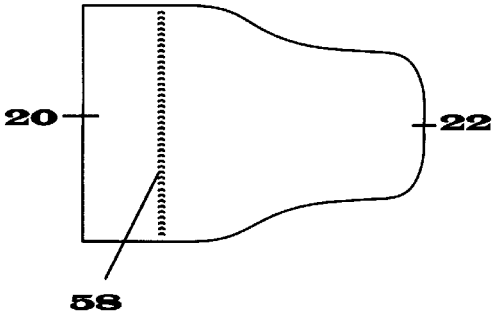
Figure 11C:
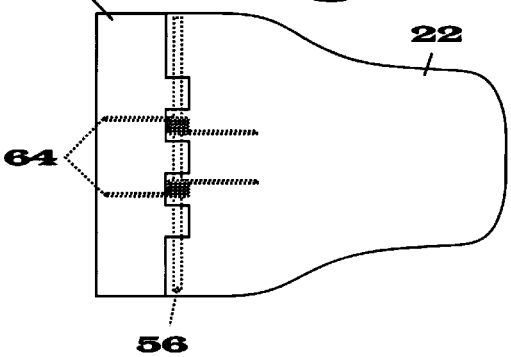

Many alternate arrangements for pivotal attachment of the pivotal member 22 to the base 20 are possible. A wide variety of hinges are readily available and relatively easy to manufacture. Pivotal attachment of the pivotal member 22 to the base 20 may also be accomplished without using a hinge. For example, FIGS. 11A–11C show the base 20 and the pivotal member 22 pivotally interlocked using a pin 56, forming a hinge themselves. Or a pivotal coupling of the base 20 and the pivotal member can be achieved using resilient material such as rubber or plastic. FIGS. 10A–10C show an alternate pivotal attachment arrangement by molding or forming a unitary element comprising a base portion and a pivotal portion with a crease 58 where the pivotal portion meets the base portion, allowing the pivotal member to be pivotally urged upward on its front end.

Returning now to a typical embodiment, FIGS. 4A and 4B illustrate the advantages of the aforementioned novel structure. By omitting any strap or impeding elements in the foot engageable portion 54 of the binding devise (FIG. 4A), and retracting the pivotal member 22 completely within the base 20 so the pivotal member and the base rest on the deck of the surfboard at the same elevation, the binding devise creates a flat comfortable paddling surface (FIG. 4B). The tapered edges of the base 20 provide a smooth, comfortable transition from the deck of the surfboard to the upper surface of the binding devise. This superior, retracting design can be made extremely thin; the result is minimal elevation above the deck of the surfboard, and enhanced comfort and maneuverability.

Figure 5A:
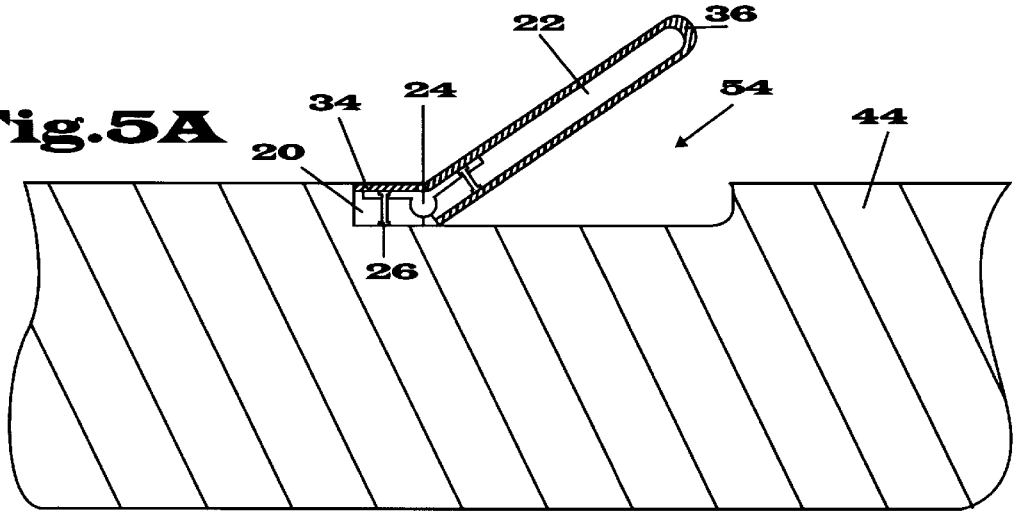
FIGS. 5A and 5B show a sectional view of a retractable binding devise recessed into the deck of a surfboard in the raised and retracted position respectively.
Figure 5B:
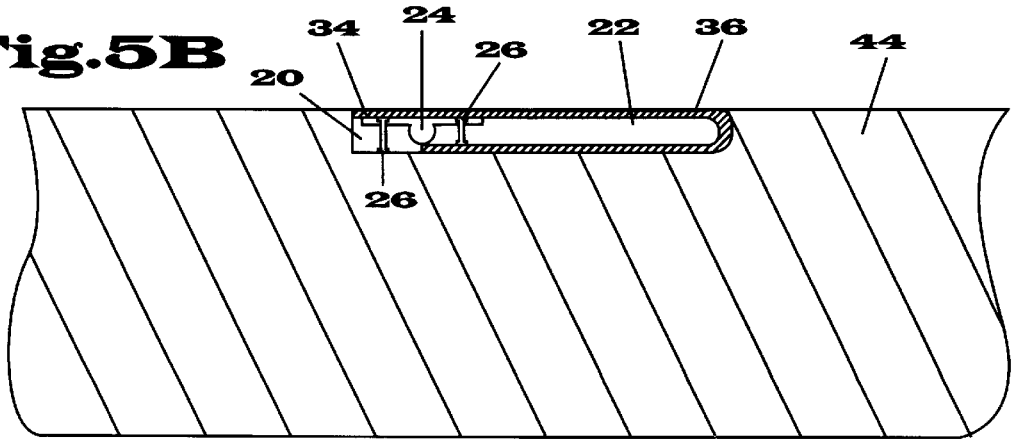

FIGS. 5A and 5B illustrate a similar binding devise recessed into the deck of a surfboard 44. In this embodiment, the mechanisms for springing upward the pivotal member 22 and terminating its upward urging are built into the hinge. Elevation above the deck of the surfboard is completely eliminated when the devise is in the lowered, retracted position (FIG. 5B). This proposed structure overcomes the great design obstacle of providing the surfer a binding devise that is comfortable to lay on in the prone paddling position. The thinness of the present design only minimally reduces the structural strength of the surfboard, as only a thin recess into the surface of the board must be provided to eliminate any elevation above the deck of the board. Recessing a layered or elevated devise into the deck of a board would reduce the structural integrity of the surfboard (which is exposed to a great deal of stress and prone to breakage). Providing a comfortable, flat paddling surface without any elevation above the deck, while minimally reducing the structural integrity of the surfboard is an object and advantage heretofore not recognized or solved.

Returning now to FIGS. 1A and 1B, the upper surface of the base 20 is padded with a microcell waterproof foam with a non-slip surface 34. The padding material 34 is adhered to the base 20 using a pressure-sensitive adhesive. Any suitable alternate padding material may be substituted. Alternate methods of attaching the padding 34 to the base 20 may be used such as: using other forms of adhesive, stitching, or forming a unitary base element with padded material on the upper surface. A similar or substantially identical padding material 36 surrounds the pivotal member 22, and is similarly adhered.

An elastic strap 30 is attached on its first end near the front end of the pivotal member 22, and on its second end near the back end of the base 20. The strap 30 may be attached using an adhesive, stitching, inserting the strap though a slit in the base 20 and a slit in the pivotal member 22, or any combination thereof. The elastic strap 30 is stretched tightly between the base member 20 and the pivotal member 22, springably urging upward the front end of the pivotal member 22 as the strap contracts. FIG. 1B illustrates the pivotal member 22 in the retracted position; FIG. 1A illustrates the pivotal member 22 in the raised position, urged upward by the strap 30. A plurality of straps may also be used for increased springing action. The elastic strap 30 may also be entirely omitted in favor of a substitutable element for springably urging upward the front end of the pivotal member 22 such as: a spring, resilient band, etc. Instead, the springing element may be built into the pivotal attachment using a springable hinge or another form of resilient hinge.

The upward urging of the front end of the pivotal member 22 is terminated at a predetermined angle using two looped strips of nylon webbed material 28, one on each side of the pivotal member 22, near its back end. FIG. 1B shows a loop of material 28 on each side of the pivotal member 22. The first end of each strip 28 is inserted through a slit in the pivotal member 22 and a slit in the base member 20 and is attached to its own second end, forming a loop around a side portion of the base and pivotal member (see the looped strip 28 of FIG. 1A). When the pivotal member 22 is in the retracted position (FIG. 1B), there is substantial slack in the strips 28 to allow the front end of the pivotal member 22 to be springably urged upward. As shown in FIG. 1A, when the pivotal member reaches the predetermined angle, there is no more slack in the strips 28, and the strips provide substantial resistance to terminate the upward urging of the pivotal member 22. The strips 28 are far enough back as to not impede engagement of the user's foot. The strips 28 may be adjustable using hook-and-loop releasable fastening material (like a Velcro® watch band) or a suitable alternative method. This novel feature allows a surfer to set the angle of incline of the pivotal member 22, based on foot size or personal preference. One strip may be used instead of two to terminate the upward urging of the pivotal member, or a plurality of strips may be used. Any material that provides substantial strength to hold the pivotal member in place as the surfer exerts pressure against the pivotal member may be substituted. The strips may also be eliminated entirely by substituting a hinge that ceases to pivot upward at a predetermined angle, or substituting a catch extending between the pivotal member 22 and the base member 20 that terminates the upward urging of the pivotal member at a predetermined angle. As such hinges and catches are so common, no illustrations are provided. Such a hinge or catch may similarly have an adjustability feature allowing a surfer to adjust the angle at which the pivotal member is to terminate its upward urging.

At the front end of the cavity 32, on the base 20 is a lock 40 designed to lock the pivotal member 22 retracted into the base 20. FIG. 1A illustrates a lock insertion member 52 disengaged, allowing the front end of the pivotal member 22 to springably pivot upwards. FIG. 1B illustrates the lock 40 engaged. The insertion member 52 is inserted into the insertion point 42 of the pivotal member 22, holding the pivotal member 22 retracted into the base 20. This novel locking feature allows surfers to preferentially decide whether or not to employ the binding devise. When locked in the retracted position, the binding devise doubles as an anti-slip pad a surfer may stand on for frictional traction. Alternative locking arrangements are possible such as: using interlocking releasable fastening material to hold down the pivotal member; allowing the surfer to disengage the springing means thus eliminating the upward urging; or strapping down the pivotal member. Another alternative is to design the lock similar to the clicking lock and unlock action presently available for cabinet doors. This design would enable surfers to operate the lock with another body part, without the use of hands.

Attached to the bottom surface of the base 20 using a pressure-sensitive adhesive is a first component of interlocking releasable fastening material 38, preferably the hook-bearing component of the cooperating hook and loop releasable material. The cooperating component of releasable fastening material (in this case, loop-bearing strips) are similarly attached to the deck of a surfboard. The advantage of this arrangement is that it allows for complete removability and adjustability of the binding devise. Any other suitable form of cooperating interlocking fastening means may be substituted. In alternate embodiments, the binding devise may be securely attached to the surfboard with a peel-and-stick adhesive, fiberglassing the binding devise into the deck of the board (FIGS. 5A and 5B), screwing it onto or into the deck of the board, snapping it into slots on the deck of the board, etc.

FIGS. 10A–11C illustrate a number of alternate embodiments. Of particular note, when the pivotal member 22 is lowered, its upper surface is at substantially equivalent elevation as the upper surface of the base member 20. FIGS. 10A–10C show three embodiments of a binding devise designed as a unitary element with a base portion 20 and a pivotal portion 22. A crease 58 allows the pivotal portion 22 to be springably urged upward on its front end. In these embodiments, the binding devise is formed of a resilient material such as rubber or polypropelene plastic. FIG. 10A shows the base portion 20 surrounding the pivotal portion 22. FIG. 10B shows the base portion 20 on both sides of the pivotal portion 22. FIG. 10C shows the base portion 20 behind the pivotal portion.

FIGS. 11A–11C show three embodiments of a binding devise with an interlocking base member 20 and pivotal member 22 held together by a pin 56. This arrangement eliminates any hinge element, yet still allows the front end of the pivotal member 22 to be springably urged upward. Three different springing means are illustrated. FIG. 11A shows the base member 20 surrounding the pivotal member 22. A pair of resilient bands 60 are shown as the springing mechanisms. FIG. 11B show the base member 20 on both sides of the pivotal member 22. A pair of compression springs 62 are shown as the springing mechanisms. FIG. 11C shows the base member 20 behind the pivotal member 22. A spring 64 is shown as the springing mechanism.

Operation—FIGS. 1B, 4A–4B, 6–9

Figure 6:
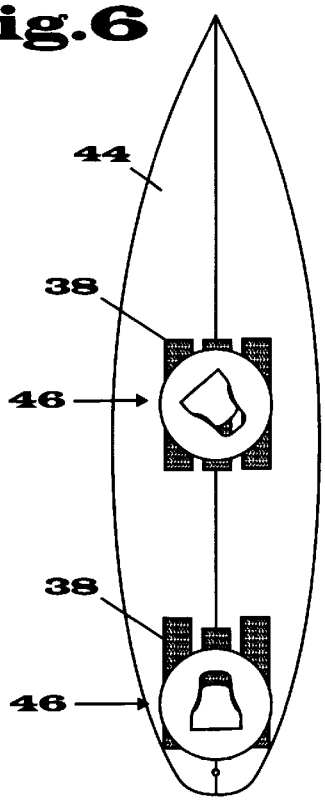
FIG. 6 shows a top view of a surfboard with a pair of binding devices attached to the deck of a surfboard.

FIG. 6 (top view) shows the deck of a surfboard 44. A plurality of strips of loop-bearing releasable fastening material 38 are attached to the deck of the surfboard 44 approximately where a surfer places his or her front and back feet when riding. The strips 38 are preferably applied with a peel-and-stick adhesive backing, but may be adhered in any suitable manner resulting in a secure adhesion. A first binding devise 46 (the embodiment shown here has internal springing and terminating mechanisms) with cooperating elements of releasable fastening material on the bottom surface is positioned on top of the cooperating component of fastening material 38 where the surfer places his or her front foot. A similar second binding devise is positioned on top of the fastening material where the surfer places his or her back foot. The union of the interlocking hook-and-loop fastening materials firmly attaches the binding devises to the deck of the surfboard, yet still advantageously allows for complete removability and adjustability. As previously indicated, alternative embodiments may include secure attachment to the deck of a surfboard.

As the surfer lays in the prone paddling position atop his or her board, he or she places his or her chest on top of the front binding device urging downward the pivotal member 22 and its protective padding 36 into the cavity of the base 30 and its protective padding 34 (see FIG. 4B). This retracting action creates a thin, flat, comfortable paddling surface. The surfer may rest his or her legs on top of the back binding devise to retract the pivotal member 22 or may alternatively straddle the pivotal member of the back binding devise.

Figure 7:
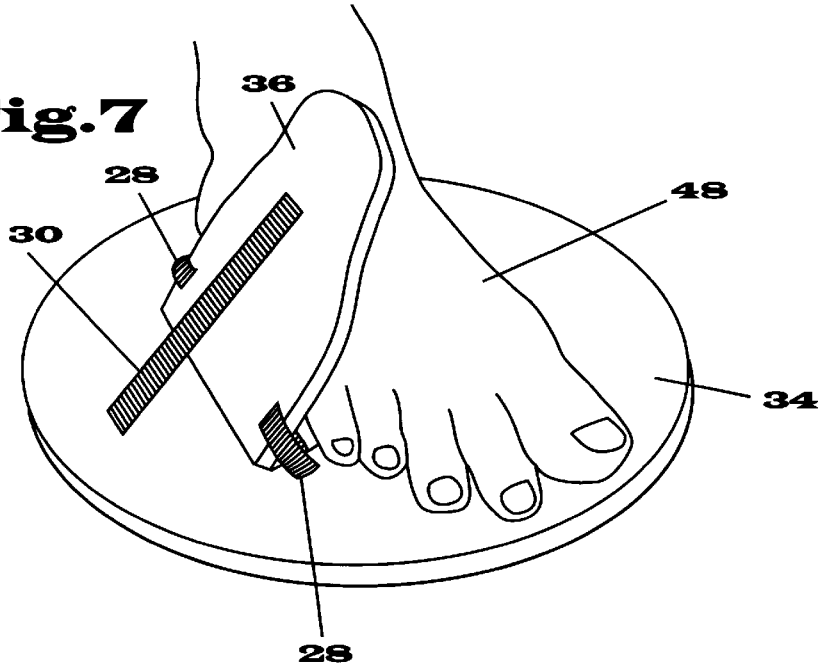
FIG. 7 shows a perspective view of a retractable binding devise in use, with a surfer's foot wedged between the pivotal member and the base member.

As the surfer paddles into a wave and stands, the weight of his or her body is removed from the binding devises. On each devise, the elastic strap 30 or an equivalent springing mechanism, urges upward the front end of the pivotal member 22. The nylon strips 28 or equivalent terminating mechanisms halt the upward urging of the front end of the pivotal member at a predetermined angle. In a natural standing motion, the surfer inserts his or her foot into the open portion of the wedge created between the base and the pivotal member as shown in FIG. 7. As there is no impeding strap in the foot engageable portion, engagement is facilitated. The lack of any clinching motion further enables the surfer to make the minor foot adjustments necessary to surf. The wedging action of the surfer's foot or feet into the binding devise(s) provides multi-directional support and attachment enabling the surfer to perform advanced technical maneuvers. When the surfer completes his or her wave (or wipes out), his or her foot or feet are easily disengaged from the open wedge of the binding devise. The surfer may lay again in the prone paddling position atop the board and the binding devises are again retracted for comfortable paddling.

Figure 8:
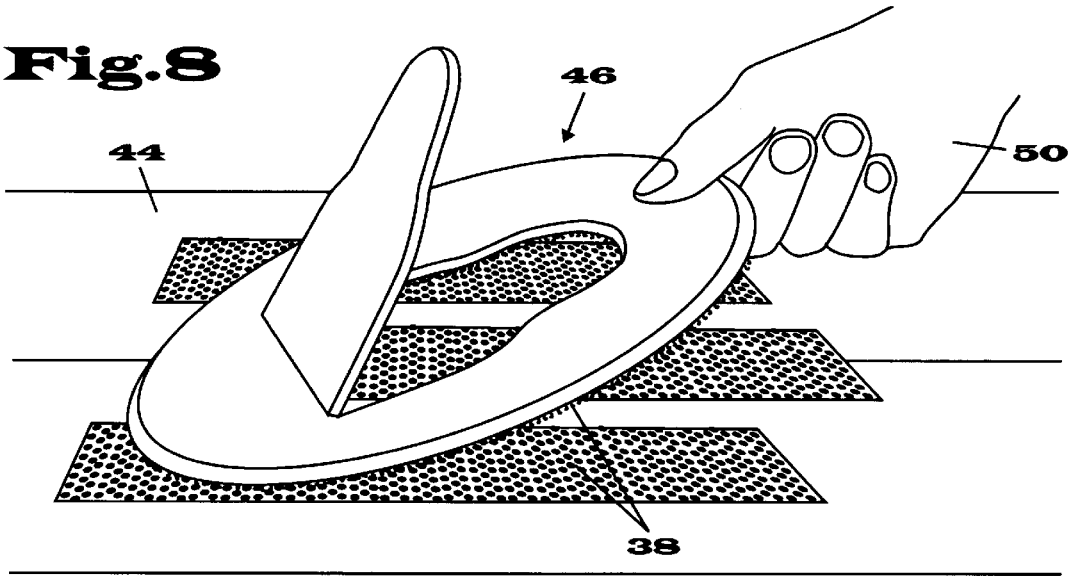
FIG. 8 shows a perspective view of a retractable binding devise being removed from the deck of a surfboard.
Figure 9:
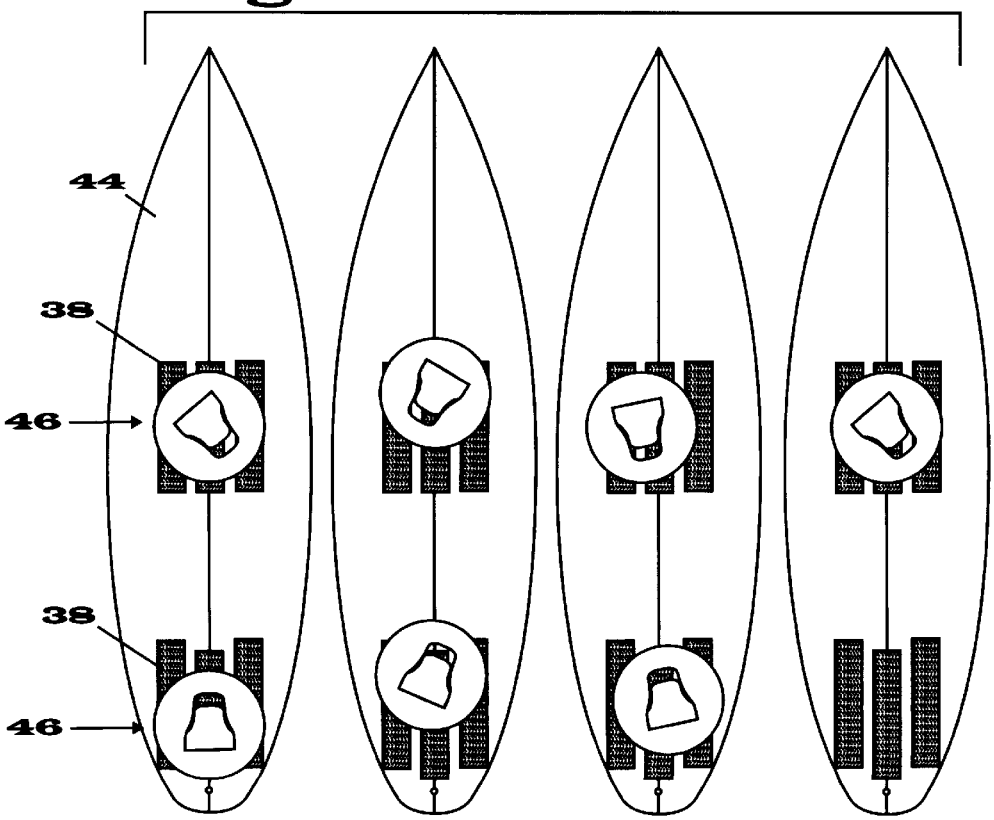
FIG. 9 shows a top view of a surfboard four times, three with a pair of retractable binding devises adjustably positioned on the deck of the surfboard, and one with a single binding devise.

Turning now to FIG. 8 (perspective view), if the surfer wishes to adjust his or her binding devise 46, he or she simply lifts the base of the binding device 46 off the deck of the surfboard 44, releasing the interlocking releasable fastening materials 38 and repositions the binding devise in the new desired position, creating a new union of the interlocking fastening materials 38. As common with many other hook-and-loop attachments, a piece of material may be attached to the base of the binding devise to facilitate the releasing of the fastening materials. FIG. 9 (top view) shows the adjustability feature of the present invention. The surfer may quickly and easily adjust either binding devise in 360 degree rotation, left or right, forward or backward, or any combination thereof, without the use of tools. If desired, one or both device(s) can be completely removed.

Returning now to FIG. 1B, if at any point during surfing, the surfer wishes not to utilize the binding devices, or wishes to lock them down while paddling, he or she may engage the lock 40 by inserting the lock insertion member 52 into the lock insertion point 42 on the pivotal member 22, locking the pivotal member into the base 20. Once locked in the retracted position, the surfer may ride with his or her feet on top of the padded binding devise and use the upper surface as a traction pad, similar to those presently employed with surfboards for frictional traction. The surfer may similarly choose to lock the pivotal members in the retracted position for improved storage or transport of the board.

From the description of the structure and operation of my binding devise, a number of advantages become evident:

a) the binding devise is designed for surfers' feet and will provide support and maneuverability without the use of hands to perform maneuvers;

b) the binding devise will provide multi-directional support and attachment so surfers may lift their board by lifting their feet, facilitating advanced maneuvers;

c) the binding devise provides an open end which will allow surfers to engage their feet in a quick, natural movement which does not require the use of hands or cumbersome movements;

d) the pivotal member of the binding devise completely retracts into the base, and rests on the deck of the surfboard providing a flat, comfortable paddling surface;

e) by the nature of its improved design, the devise will minimize or completely eliminate the elevation above the deck of the surfboard, enhance comfort and control, minimally reduce the structural integrity of a surfboard when recessed into its deck, and will minimize additional weight.

f) the binding devise does not include an impeding strap in the foot engageable portion or a mechanical clinching action, and therefore will not restrict engagement or necessary foot adjustments;

g) the binding devise will be completely removable, quickly and easily without the use of tools for readjustment or more efficient transport and storage of the surfboard;

h) the binding devise will allow surfers to retract the pivotal member into the base and easily lock it in the retracted position to allow surfers to preferentially select whether or not to employ the devise on a wave-by-wave basis;

i) the binding devise is adjustable in complete rotation, from side to side, and forward and backward, without the use of tools;

j) the binding devise will allow surfers safe, easy disengagement.

Conclusion, Ramifications, and Scope

Although the description above contains many specificities, these should not be construed as limiting the scope of the invention but as merely providing illustrations of some of the presently preferred embodiments of this invention. For example, the binding device(s) may be used with other sports or for other applications; the base member may take a different shape such as triangular, rectangular, oval, trapezoidal, etc.; the base portion and pivotal portion may be portions of a unitary element; the base portion and the pivotal portion may be arranged in a variety of ways such as side by side, or front to back; many possible springing mechanisms can be substituted to upwardly urge the front end of the pivotal member; many possible terminating mechanisms can be substituted to halt the upward urging at a predetermined angle; many possible locking mechanisms can be used to lock the pivotal member in the lowered position; the binding devise can be securely attached to the surfboard; the binding devise may be recessed within the deck of a surfboard.

Thus the scope of the invention should be determined by the appended claims and their legal equivalents, rather than by the examples given.

What is claimed and desired to be secured by Letters Patent of the United States is:

1. A retractable surfboard foot binding devise comprising:

a) a base member with a cavity centrally defined therein attachable to the deck of a surfboard; and b) a pivotal member, comprising a front end and a back end, positioned within the cavity of said base member, pivotally coupled to said base member such that the front end of said pivotal member is springably urged upward to a predetermined angle, whereby when urged upward, said pivotal member creates an inclined plane under which a surfer may position his or her foot for support and attachment, and when urged downward said pivotal member retracts into the cavity of said base member, creating a relatively flat comfortable paddling surface.

2. The binding devise of claim 1 wherein said base member and said pivotal member are portions of a unitary binding devise.

3. The binding devise of claim 1 wherein said base member has a first element of interlocking releasable fastening means on its bottom surface, and said surfboard has a second cooperating element of interlocking releasable fastening means on its deck enabling said binding devise to be completely removed, adjusted and reattached to said surfboard.

4. The binding devise of claim 1 wherein said base member is recessed into the deck of a surfboard, thereby creating no elevation above the deck of the surfboard when said pivotal member is retracted into said base member.

5. The binding devise of claim 1 further including protective padding on the upper surface of said base member and on the upper and lower surfaces of said pivotal member.

6. The binding devise of claim 1 wherein means for springably urging upward the front end of said pivotal member are selected from the group consisting of: an elastic strap, a springable hinge, a resilient band, or a spring.

7. The binding devise of claim 1 wherein means for terminating the upward urging of the front end of said pivotal member are selected from the group consisting of: a strip of material, a string, a hinge that ceases to pivot upward at a predetermined angle, or a catch extending between said pivotal member and said base member.

8. The binding devise of claim 1 wherein springing and terminating means are built into the pivotal attachment of said pivotal member to said base member.

9. The binding devise of claim 1 further including means to lock said pivotal member down into said base member allowing a surfer to preferentially decide whether or not to employ said binding devise.

10. A retractable surfboard foot binding devise comprising:

a) a base member at tachable to the deck of a surfboard; and b) a pivotal member having a front end and a back end; and c) said pivotal member is pivotally coupled to said base member such that the front end of said pivotal member may be springably urged upward to a predetermined angle and the upper surface of said pivotal member may be urged downward to a substantially equivalent elevation as the upper surface of said base member, whereby when urged upward, said pivotal member creates an inclined plane under which a surfer may position his or her foot for support and attachment, and when urged downward creates a relatively flat paddling surface without elevation beyond the upper surface of said base member.

11. The binding devise of claim 10 wherein said base member and said pivotal member are portions of a unitary binding devise.

12. The binding devise of claim 10 wherein said base member is releasably and adjustably attachable to the deck of a surfboard by adhering a first element of interlocking releasable fastening means to the bottom surface of said base member, and adhering a second element of interlocking releasable fastening means to th e deck of a surfboard.

13. The binding devise of claim 10 wherein said base member is recessed into the deck of a surfboard, thereby creating no elevation above the deck of the surfboard when said pivotal member is lowered to the same elevation as said base member.

14. The binding devise of claim 10 wherein means for springably urging upward the front end of said pivotal member are selected from the group consisting of: an elast ic strap, a springable hinge, a resilient band, or a spring.

15. The binding devise of claim 10 wherein means for terminating the upward urging of the front end of said pivotal member are selected from the group consisting of: a strip of material, a string, a hinge that ceases to pivot upward at a predetermined angle, or a catch extending between said pivotal member and said base member.

16. The binding devise of claim 10 wherein springing and terminating means are built into the pivotal attachment of said pivotal member to said base member.

17. The binding devise of claim 10 wherein there is no impeding strap or element in the foot engageable portion.

18. The binding devise of claim 10 further including means to lock the upper surface of said pivotal member down to a substantially equivalent elevation as the upper surface of said base member allowing a surfer to preferentially decide whether or not to employ said binding devise.

19. A retractable surfboard foot binding devise comprising:

a) a base member attachable to the deck of a surfboard; and b) a pivotal member having a front end and a back end, pivotally coupled to said base member such that the upper surface of said pivotal member and the upper surface of said base member are at a substantially equivalent elevation when the front end of said pivotal member is urged downward; and c) springing means for springably urging upward the front end of said pivotal member; and d) terminating means for terminating the upward urging of said pivotal member at a predetermined angle.

20. The binding devise of claim 19 wherein said base member and said pivotal member are portions of a unitary binding devise.

* * * * *